United States Patent [19]

Frisbee

[11] Patent Number: 4,583,906

[45] Date of Patent: Apr. 22, 1986

[54] HYDRAULIC BACKHOE LATCH MECHANISM

[75] Inventor: Claude M. Frisbee, Bettendorf, Iowa

[73] Assignee: J. I. Case Company, Racine, Wis.

[21] Appl. No.: 625,542

[22] Filed: Jun. 28, 1984

[51] Int. Cl.[4] ..... E02F 3/34

[52] U.S. Cl. ..... 414/686; 172/272; 172/274; 212/175; 212/185; 212/189; 280/461 A; 403/152; 403/161; 414/723

[58] Field of Search ..... 414/686, 708, 723, 724; 212/175, 185, 188, 189; 37/117.5; 172/272–275; 280/461, 461 A, 415 R, 759; 403/100, 152, 161, 163

[56] References Cited

U.S. PATENT DOCUMENTS

| | | | |
|---|---|---|---|
| 2,961,102 | 11/1960 | Pitman | 212/189 |
| 3,298,724 | 5/1964 | Coleman et al. . | |
| 3,362,548 | 1/1968 | Cunningham | 212/189 X |
| 3,844,425 | 10/1974 | Bailey . | |
| 3,896,884 | 7/1975 | Casey . | |
| 4,034,998 | 7/1977 | Iijima et al. | 414/686 X |
| 4,142,642 | 3/1979 | Myers | 414/686 X |
| 4,208,162 | 6/1980 | Neitzel | 414/686 |
| 4,242,034 | 12/1980 | Schmitz . | |
| 4,355,945 | 10/1982 | Pilch | 414/686 |

*Primary Examiner*—Joseph E. Valenza
*Assistant Examiner*—Lyle Kim
*Attorney, Agent, or Firm*—Dressler, Goldsmith, Shore, Sutker & Milnamow, Ltd.

[57] ABSTRACT

A hydraulically-operated latch mechanism is disclosed for releasably maintaining a backhoe in its lowered, working position on an associated material handling implement. In the preferred embodiment, the mechanism includes a movable latch member pivotally mounted on the implement for movement between engaged and disengaged positions. A latch pin is provided on the frame of the backhoe for cooperation with the latch member whereby the latch pin is adapted to be received by the latch member in the engaged position thereof for holding the backhoe against movement relative to the implement. A latch hydraulic motor is provided in operative connection to the pivotal latch member for effecting movement between the engaged and disengaged positions. Notably, the latch member is configured to define wedge-shaped openings which provide a gripping action when the latch member is in its engaged position so that a very rigid connection is formed between the backhoe and the implement when the backhoe is in its working position.

4 Claims, 4 Drawing Figures

HYDRAULIC BACKHOE LATCH MECHANISM

TECHNICAL FIELD

The present invention relates generally to arrangements for mounting a backhoe on an associated material handling implement, and more particularly to a hydraulically-operated backhoe latch mechanism for releasably securing a backhoe in a lowered working position while minimizing movement between the backhoe and the associated implement.

BACKGROUND OF THE INVENTION

One of the most versatile types of material handling equipment is a hydraulically-operated backhoe, which is typicallly mounted on a tractor or like implement for use. As with all types of material handling equipment, efficient and reliable operation is always a major design consideration, and thus improvements are always being made in such equipment in an effort to enhance efficient and convenient use under the severe operating conditions to which such equipment is typically subjected.

Part of the versatility of a backhoe is achieved by mounting the device on a tractor or the like to permit the backhoe to be operated at any desired work area. To this end, many backhoes are configured for pivotal mounting on an associated implement such that the backhoe is relatively movable from a lowered working position to a raised, so-called transport position. Disposition of the backhoe in the out-of-the-way transport position facilitates convenient movement of the device from one work area to another, while permitting the various hydraulic fluid connections between the backhoe and the associated implement to remain ready for use.

Bearing in mind that minimization of equipment "down time" is always important for enhancing efficiency in material handling operations, it is very desirable to provide a latch mechanism for connecting a backhoe to a material handling implement which facilitates convenient movement of the backhoe between its working and transport positions. At the same time, it is further desirable that such an arrangement be configured to provide a very rigid connection between the backhoe and the implement when the backhoe is in its working position since this lends desired stability to the backhoe, and minimizes wear which can otherwise take place if the interconnection is not sufficiently rigid.

With the above goals in mind, the present backhoe latch mechanism has been specifically configured for reliable and convenient hydraulic operation, and has further been configured to permit the backhoe to be very rigidly connected to the associated implement when the backhoe is in its lowered working position.

SUMMARY OF THE INVENTION

A hydraulic latch mechanism for connecting a backhoe to a material handling implement is disclosed which promotes very convenient movement of the backhoe between raised and lowered positions with respect to the implement. Notably, the latch mechanism is hydraulically operated to promote its convenient use, and has been specifically configured such that a very rigid connection is provided between the backhoe and the implement when the backhoe is in its lowered position for use.

The present latch mechanism includes an upper pivot which pivotally connects a frame of the backhoe to the associated implement for movement of the backhoe relative to the implement about a horizontal axis. The backhoe is thus movable about the horizontal axis when the backhoe is moved between its raised transport and lowered working positions.

The present latch mechanism further includes a latch member movably mounted on one of the implement and the backhoe frame for movement between engaged and disengaged positions. In the illustrated embodiment, the present mechanism further includes a latch pin mounted on the other of the implement and the backhoe frame for cooperation with the latch member. By this construction, the latch pin is adapted to be received and retained by the latch member in the engaged position thereof so that the backhoe is held against movement with respect to the implement. The latch pin is released from the latch member in the disengaged position thereof so that the backhoe is movable about the horizontal axis defined by the upper pivot.

Convenient and efficient operation of the present latch mechanism is facilitated by the provision of a hydraulic latch motor, preferably comprising a double-acting fluid ram, which is operatively connected to the pivotal latch member for selectively moving the latch member between its engaged and disengaged positions. In the illustrated embodiment, a hydraulic fluid conduit is provided which joins the latch motor in fluid communication with a stabilizer hydraulic ram of the backhoe, with the stabilizer ram provided for effecting raising and lowering of one of the vertically movable stabilizers of the backhoe. By this arrangement, fluid pressurization of the stabilizer hydraulic ram for lowering the associated stabilizer arm effects fluid pressurization of the latch motor for urging the pivotal latch member into its engaged position.

Notably, the present latch mechanism has been specifically configured so that a very rigid connection is formed between the backhoe and the implement when the pivotal latch member is in its engaged position. To this end, the latch member is pivotally mounted on the implement by a latch pivot construction which includes a latch pivot pin attached to one of the latch member and the implement, and a first generally wedge-shaped opening defined by the other of the latch member and the implement through which the latch pivot pin extends. By this arrangement, a gripping action is effected between the wedge-shaped opening and the latch pivot pin when the latch member is urged into its engaged position by the hydraulic latch motor.

The present invention contemplates that a similar gripping action is effected between the latch member and the backhoe frame when the latch member is urged into its engaged position. To this end, the latcn pin of the mechanism is preferably mounted on the backhoe frame, and is adapted to be received by a second generally wedge-shaped opening defined by the pivotal latch member when the latch member is in its engaged position.

Convenient operation of the present latch mechanism is further facilitated by the provision of a stop arrangement which coacts with the latch pin in the disengaged position of the latch member to automatically position the latch pin for retention by the latch member when the latch member is moved to its engaged position. In the embodiment shown, the pivotal latch member includes a generally upstanding stop portion which defines a stop surface against which the backhoe-mounted latch pin reacts. In the preferred form, the stop surface comprises a continuation of one of the sides of the second wedge-shaped opening, and thus the latch pin is guided into and received in the second wedge-shaped opening for effecting the desired gripping action as the pivotal latch member is moved by its motor from the disengaged position to the engaged position.

Numerous other features and advantages of the present invention will become readily apparent from the following detailed description, the accompanying drawings, and the appended claims.

DETAILED DESCRIPTION

Figure 1:
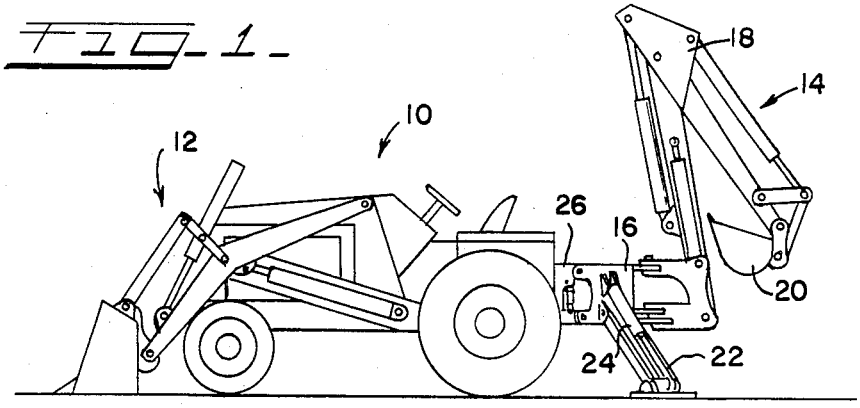
FIG. 1 is a side elevational view of a material handling implement, shown as a tractor, having a backhoe mounted thereon with a hydraulic latch mechanism embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference first to FIG. 1, therein is illustrated a material handling implement, shown as a tractor 10, including a front-end loader 12 and a backhoe 14 mounted thereon. As will be recognized by those familiar with the art, backhoe 14 is shown in a typical configuration, including a backhoe frame 16 which pivotally supports an articulable boom assembly 18 having a bucket 20 mounted at the free end thereof.

In order to enhance the stability of the backhoe 14 during material handling operations, the backhoe includes a pair of stabilizer arms 22 (one being shown) mounted at generally laterally opposite sides of backhoe frame 16. The vertically movable stabilizer arms 22 are operated by a pair of double-acting, stabilizer hydraulic fluid rams 24 (one being shown) respectively operatively connected with the stabilizer arms 22. Selective fluid pressurization of the stabilizer rams permits selective positioning of the stabilizer arms, with the arms being lowered for providing a relatively wide "stance" for the backhoe 14 to enhance stability during operation.

Figure 2:
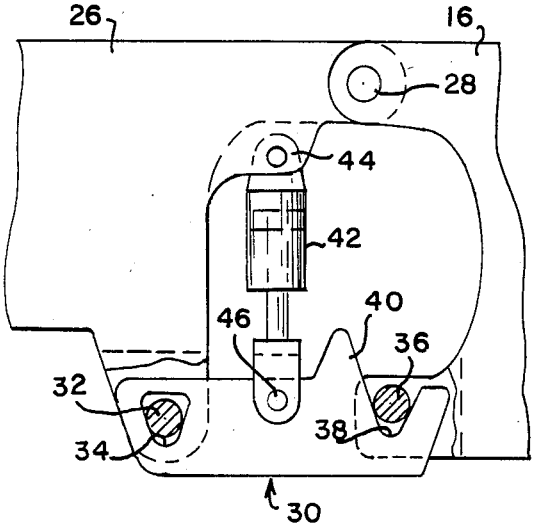
FIG. 2 is an enlarged side elevational view of the backhoe latch mechanism shown in FIG. 1, illustrating the mechanism in an engaged disposition.
Figure 3:
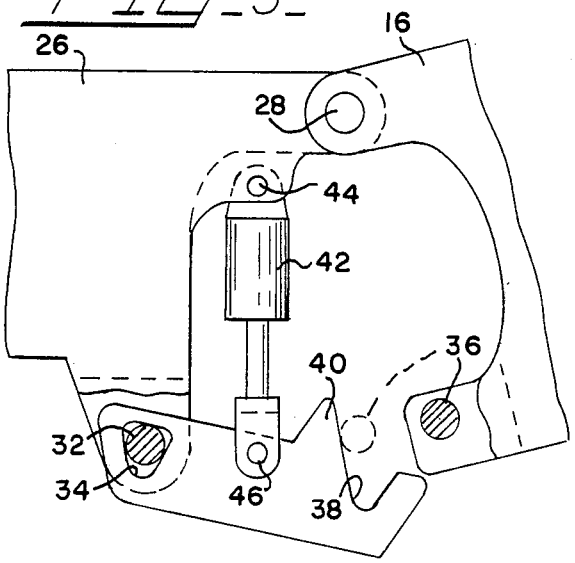
FIG. 3 is a side elevational view similar to FIG. 2 illustrating the present latch mechanism in a disengaged disposition.

With particular reference now to FIGS. 2 and 3, therein is illustrated in detail the hydraulic latch mechanism in accordance with the present invention. The tractor 10 is illustrated as including a rearwardly disposed implement mount 26 to which the backhoe 14 is connected. To this end, the present construction includes an upper pivot pin 28 which pivotally connects the backhoe frame 16 to the implement mount 26 for movement of the backhoe 14 relative to the tractor 10 about a horizontal axis. In this manner, the backhoe 14 can readily be moved from a lowered, working position to a raised, transport position. Upper pivot pin 28 can be configured for removability to permit complete detachment of the backhoe 14 from the tractor 10.

The present latch mechanism further includes a latch member, generally designated 30, which is pivotally movably mounted on the implement mount 26. The latch member 30 is configured for movement between an engaged position (FIG. 2) wherein the backhoe 14 is held against movement with respect to the tractor 10, and a disengaged position (FIG. 3) wherein the backhoe 14 can be pivoted about the horizontal axis defined by upper pivot pin 28 between its transport and working positions.

In the illustrated embodiment, the latch member 30 is pivotally connected to the implement mount 26 by a latch pivot pin 32 affixed to the implement mount. Notably, the latch member 30 defines a first generally straight-sided, downwardly converging wedge-shaped opening 34 through which the latch pivot pin 32 extends. As will be furtner described, the wedge-shaped opening 34 coacts with the pivot pin 32 in the engaged position of the latch member 30 to effect a gripping action which minimizes movement between the backhoe 14 and the implement mount when the latch member 30 is in its engaged position.

The present latch mechanism further includes a latch pin 36, which in the illustrated embodiment is affixed to backhoe frame 16 for cooperation with latch member 30. As will be recognized, the latch pin 36 could instead be provided on the movable latch member 30, with the backhoe frame 16 provided with suitable means for receiving the latch pin for holding the backhoe in fixed relation with respect to the tractor 10.

The latch pin 36 is adapted to be received and retained by the pivotal latch member 30 in the engaged position thereof, and to this end, the latch member 30 defines a second generally straight-sided, downwardly converging wedge-shaped opening 38 which is configured to effect a gripping action with the latch pin 36 when the latch pin is received within the opening 38. This arrangement further minimizes any movement between the backhoe 14 and the tractor 10 when the backhoe is in its lowered working position, thus providing a very rigid interconnection between the backhoe and the tractor.

In the preferred embodiment, the latch member 30 includes a generally upstanding "thumb" stop portion 40. Notably, the stop portion 40 is configured such that it is engagable by the latch pin 36 when the latch member 30 is in its disengaged position (see FIG. 3). This arrangement promotes very convenient use of the present latch mechanism since the stop portion 40 acts to automatically position the latch pin 36 for disposition within the wedge-shaped opening 38 as the latch member 30 is moved from its disengaged position to its engaged position. In this regard, the stop surface defined by the stop portion 40 comprises a continuation or extension of one of the sides of the wedge-shaped opening 38.

Hydraulically-effected movement of the latch member 30 between its engaged and disengaged positions is provided by a hydraulic latch motor 42 operatively connected to the latch member. Latch motor 42 preferably comprises a double-acting hydraulic ram, and is pivotally connected at 44 to implement mount 26, and is pivotally connected at 46 to the latch member 30. Thus, selective fluid pressurization of the latch motor 42 effects the desired movement of the latch member 30.

As noted, latch member 30 has been specifically configured to minimize any movement between backhoe 14 and tractor 10 when the backhoe 14 is in its lowered working position, and the latch pin 36 is retained and held by the latch member 30. As shown in FIG. 2 wherein the latch member 30 is in its engaged position, the wedge-shaped openings 34 and 38 respectively coact with pivot pin 32 and latch pin 36 to effect a gripping action attendant to latch member 30 being urged into its engaged position by latch motor 42. In a sense, the present latch mechanism is "self-compensating" for any wear which occurs in the mechanism since the wedge-shaped openings 34 and 38 always act to grip the respective pins 32 and 36.

It will be noted that the wedge-shaped openings 34 and 38 each converge downwardly, i.e., in a direction generally away from the direction in which latch member 30 is moved by latch motor 42 into the engaged position of the latch member. Alternate constructions can be provided to effect a like gripping action. For example, latch pivot pin 32 could be affixed to latch member 30, with implement mount 26 defining one or more upwardly converging wedge-shaped openings for pivotally receiving the pivot pin 32 mounted in this manner. Similarly, latch pin 36 could be affixed to the latch member 30, with backhoe frame 16 defining one or more upwardly converging wedge-shaped openings (and a suitable stop surface) for receiving the latch pin 36 as it is moved with latch member 30. The illustrated embodiment is preferred for ease of manufacture.

Figure 4:
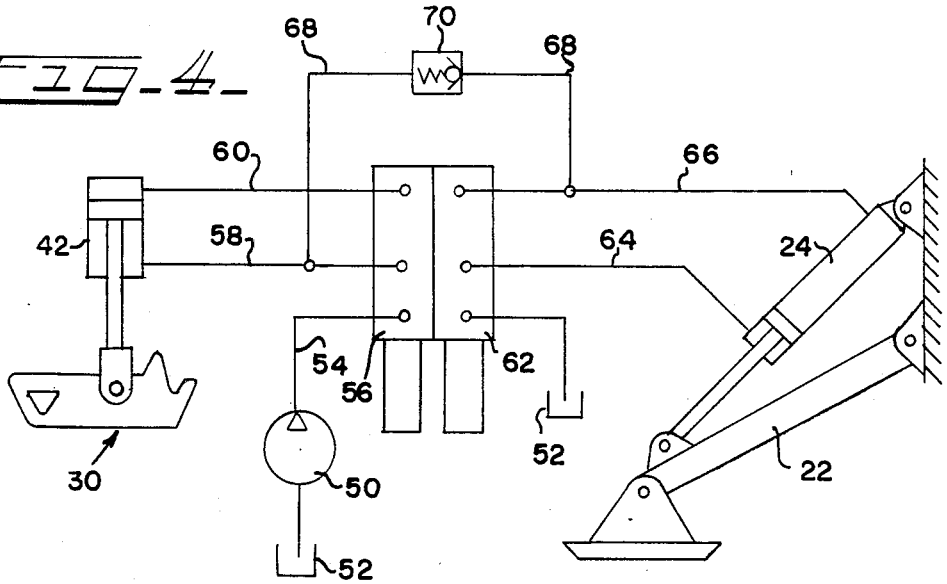
FIG. 4 is a schematic diagram illustrating a hydraulic circuit for effecting operation of the present hydraulic latch mechanism.

FIG. 4 schematically illustrates a hydraulic circuit for operation of the present latch mechanism. Pressurized fluid for operation of hydraulic latch motor 42 is provided from a pump 50, typically driven by the internal combustion engine of the tractor 10. Pump 50 draws hydraulic fluid from a reservoir 52, and directs the fluid through a fluid conduit 54 to a valve assembly.

The valve assembly includes a manually-operable valve 56 for effecting selective fluid pressurization of latch motor 42, and thus selective movement of pivotal latch member 30. To this end, a conduit 58 routes hydraulic fluid to and from the so-called rod end of latch motor 42, while a fluid conduit 60 routes fluid between the valve 56 and the so-called head end of the latch motor 42.

The valve assembly is also illustrated as including another manually-operated valve 62 for operation of stabilizer ram 24 for effecting selected vertical positioning of stabilizer arm 22. A conduit 64 routes hydraulic fluid to and from the rod end of stabilizer ram 24, while a conduit 66 routes fluid between the valve 62 and the head end of ram 24.

Notably, the hydraulic circuit is illustrated as including an interconnecting conduit 68 whicn joins in fluid communication the latch motor 42 and the stabilizer ram 24 via conduits 58 and 66. This arrangement results in fluid pressurization of latch motor 42 for urging latch member 30 to its engaged position whenever valve 62 is operated for lowering stabilizer arm 22 by pressurization of the head end of stabilizer ram 24. Because a substantial amount of fluid pressure exists in conduit 66 during operation of backhoe 14 with its stabilizers lowered, the interconnection of the stabilizer ram 24 and the latch motor 42 via conduit 68 acts to assure that the desired gripping action is maintained between the pivotal latch member 30 and the latch pivot pin 32 and the latch pin 36 received thereby. A check valve 70 operatively associated with the conduit 68 prevents the reverse flow of fluid from latch motor 42 to conduit 66, thus keeping the latch member 30 from loosening when the stabilizer arm 22 is raised by pressurization of the rod end of ram 24 via conduit 64.

From the foregoing, it will be observed that numerous modifications and variations can be effected without departing from the true spirit and scope of the novel concept of the present invention. It is to be understood that no limitation with respect to the specific embodiment illustrated is intended or should be inferred. It is, of course, intended to cover by the appended claims all such modifications as fall within the scope of the claims.

What is claimed is:

1. A hydraulic latch mechanism for connecting a backhoe having a frame to a material handling implement, comprising:

upper pivot means pivotally connecting said backhoe frame and said implement for movement of said backhoe relative to said implement about a horizontal axis;

latch means movably mounted on said implement for movement between engaged and disengaged positions;

latch pin means mounted on said backhoe frame for cooperation with said latch means, whereby in said engaged position of said latch means said latch pin means is adapted to be retained by said latch means and said backhoe is held against movement with respect to said implement, and in the disengaged position of said latch means said latch pin means is released from said latch means and said backhoe is movable about said horizontal axis relative to said implement; and hydraulic latch motor means operatively connected to said latch means for selectively moving said latch means between said engaged and disengaged positions;

said latch means defining a generally wedge-shaped opening at one end for receiving said latch pin means in the engaged position of said latch means, said wedge-shaped opening cooperating with said latch pin means for effecting a gripping action to minimize movement of said backhoe relative to said implement when said latch pin means is retained by said latch means;

said latch means being pivotally movably mounted on said implement by latch pivot pin means mounted on one of said latch means and said implement, the other of said implement and said latch means defining another wedge-shaped opening through which said pivot pin means is received for pivotal mounting of said latch means, said another wedge-shaped opening cooperating with said pivot pin means for effecting a gripping action to further minimize movement of said backhoe relative to said implement when said latch pin means is retained by said latch means;

said latch means defining stop means (40) engagable by said latch pin means in the disengaged position of said latch means, whereby said latch pin means is positioned by said stop means for retention by said latch means as said latch means is moved from said disengaged position to said engaged position.

2. A backhoe latch mechanism in accordance with claim 1, wherein said backhoe includes vertically movable stabilizer means operable by stabilizer hydraulic ram means, said latch mechanism including hydraulic fluid conduit means joining said latch motor means with said stabilizer ram means in fluid communication whereby fluid pressurization of said stabilizer ram means for lowering said stabilizer means acts through said fluid conduit means to pressurize said latch motor means for urging said latch means into said engaged position.

3. A backhoe latch mechanism in accordance with claim 2, including one-way check valve means operatively associated with said fluid conduit means for preventing flow of hydraulic fluid from said latch motor means to said stabilizer ram means via said fluid conduit means.

4. A backhoe latch mechanism in accordance with claim 1, wherein said stop means defines a stop surface comprising a continuation of one of the sides of said wedge-shaped opening defined by latch means for receiving said latch pin means.

* * * * *